US005268706A

United States Patent [19]

Sakamoto

[11] Patent Number: 5,268,706

[45] Date of Patent: Dec. 7, 1993

[54] ACTUATING CONTROL METHOD OF THERMAL HEAD

[75] Inventor: Masaki Sakamoto, Morioka, Japan

[73] Assignee: Alps Electric Co., Ltd., Tokyo, Japan

[21] Appl. No.: 836,040

[22] Filed: Feb. 12, 1992

[30] Foreign Application Priority Data

Feb. 14, 1991 [JP] Japan ..... 3-042579
Dec. 13, 1991 [JP] Japan ..... 3-352302

[51] Int. Cl.[5] ..... B41J 2/365
[52] U.S. Cl. ..... 346/76 PH; 346/1.1
[58] Field of Search ..... 346/1.1, 76 PH; 400/120

[56] References Cited

U.S. PATENT DOCUMENTS 4,514,738 4/1985 Nagato et al. ..... 346/76 PH
4,590,487 5/1986 Noguchi et al. ..... 346/76 PH
5,115,252 5/1992 Sasaki ..... 346/76 PH

FOREIGN PATENT DOCUMENTS 62-282956A 12/1987 Japan .

*Primary Examiner*—Benjamin R. Fuller
*Assistant Examiner*—Huan Tran
*Attorney, Agent, or Firm*—Guy W. Shoup; Patrick T. Bever

[57] ABSTRACT

A heating elements' row provided in the thermal head is separated into at least three blocks each including a plurality of heating elements. When each heating element is heated by turning on electricity, the last heat accumulation amount of said each heating element is calculated, as well the last sum of heat accumulation amounts in each block is calculated. And, the calculated amount of the sum of the heat accumulation amounts in each block is corrected in accordance with the position of each block in the heating elements' row. Subsequently, the time period for turning on electricity to each heating element is determined based on said calculated amount of last heat accumulation amount of said each heating element and said corrected amount of last sum of heat accumulation amount of each block, thereby adequate control of time period for turning on electricity can be performed so as to response to actual heat accumulation condition in each heating element.

As a result, the printing operation is carried out excellently so as not to cause undesirable printing density difference among heating elements laid in a row.

6 Claims, 2 Drawing Sheets

ACTUATING CONTROL METHOD OF THERMAL HEAD

BACKGROUND OF THE INVENTION (1) Field of the Invention

The present invention relates to an actuating control method of a thermal head which controls time period for turning on electricity to a thermal head in order to guarantee an excellent printing operation.

(2) Description of the Prior Art

The thermal head has a heating elements' row, in which a plurality of heating elements are disposed on a substrate in a straight line. And, the thermal head is driven by selectively turning on electricity to each heating element. In such a thermal head, since the temperatures of each heating element and the substrate increase during the printing operation due to its structural nature, the time period for turning on electricity to each heating element is necessary to be corrected by taking the increase of temperatures of each heating element and the substrate into consideration so as not to cause uneven printing finish in the printing operation.

For this correction of the time period for turning-on electricity, there has been known a method in which the correction is carried out in each heating element based on the heat accumulation amount in the periphery of each heating element or a method in which the correction is totally carried out based on the overall heat accumulation amount around the substrate as a whole.

In the case that the correction is totally carried out based on the overall heat accumulation, however, a conventional actuating control method for a thermal head was not performed by taking the position of each heating element into consideration. That is, the conventional actuating control method was carried out by merely correcting the time period for turning on electricity commonly with respect to each heating element based on the sum of previous history of turning-on of electricity to each heating element.

In the case that even if the frequency for turning on electricity to each heating element is different in the respective heating element, for example, the condition of turning-on of electricity is extremely different between the upper part and the lower part in the heating elements' row, the control is uniformly carried out with respect to each heating element. Accordingly, there was a problem such that the control cannot be carried out adequately so as to response to an actual heat accumulation amount in each heating element, thereby resulting in generation of uneven printing finish in the printing operation. And, therefore, it could not be possible to realize the printing operation guaranteeing uniform printing density.

Further, the heat accumulation in the thermal head is usually influenced with the configuration or material or printing pattern. Therefore, the edge part of the heating elements' row is likely to be cooled down easily than the central part thereof. Thus, the heat accumulation amount is generally larger in the central part than the edge part.

If the correction of turning-on time period of electricity is commonly controlled with respect to all the heating elements without taking their positions into consideration, the heat accumulation difference causes undesirable printing density difference in the printing operation. As a result, there was a problem such that the high quality printing cannot be realized.

SUMMARY OF THE INVENTION

It is therefore an object of the present invention, in order to avoid the aforementioned problems and disadvantages encountered in the prior art, to provide an improved actuating control method for a thermal head which is capable of controlling the turning-on time period of electricity adequately in response to actual heat accumulation condition in each heating element through the correction in which the position of each heating element is taken into consideration, thereby providing uniform printing density.

To accomplish the above purpose, according to the actuating control method for the thermal head in accordance with the present invention, a heating elements' row provided in the thermal head is separated into at least three blocks comprising a plurality of heating elements. When each heating element is heated by turning on electricity, the last heat accumulation amount of each heating element is calculated, as well the last sum of heat accumulation amounts of each block is calculated. And, the calculated amount of the sum of heat accumulation amounts of said block is corrected in accordance with the position of each block in the heating elements' row. Subsequently, the time period for turning on electricity to each heating element is controlled based on said calculated amount of last heat accumulation amount of said each heating element and said corrected amount of last sum of heat accumulation amounts of each block.

In accordance with the present invention, when each heating element is heated by turning on electricity, the last heat accumulation of said each heating element is calculated, and the heating elements' row is divided into a plurality of blocks. Furthermore, the last sum of heat accumulation amounts of each block is calculated. And, the calculated amount of the last sum of the heat accumulation amounts of said block is corrected in accordance with the position of each block in the heating elements' row. Subsequently, the time period for turning on electricity to each heating element is controlled based on said calculated amount of last heat accumulation amount of said each heating element and said corrected amount of last sum of heat accumulation amounts of each block. As a result, the printing operation is carried out excellently so as not to cause undesirable printing density difference among heating elements laid in a row.

The above and other objects, features and advantages of the present invention will become apparent from the following detailed description which is to be read in conjunction with the accompanying drawings.

BRIEF DESCRIPTION OF THE ACCOMPANYING DRAWINGS

DETAILED DESCRIPTION OF THE PREFERRED EMBODIMENT

Hereinafter, referring now to FIGS. 1 to 3, the preferred embodiment of the present invention is explained in more detail.

Figure 1:
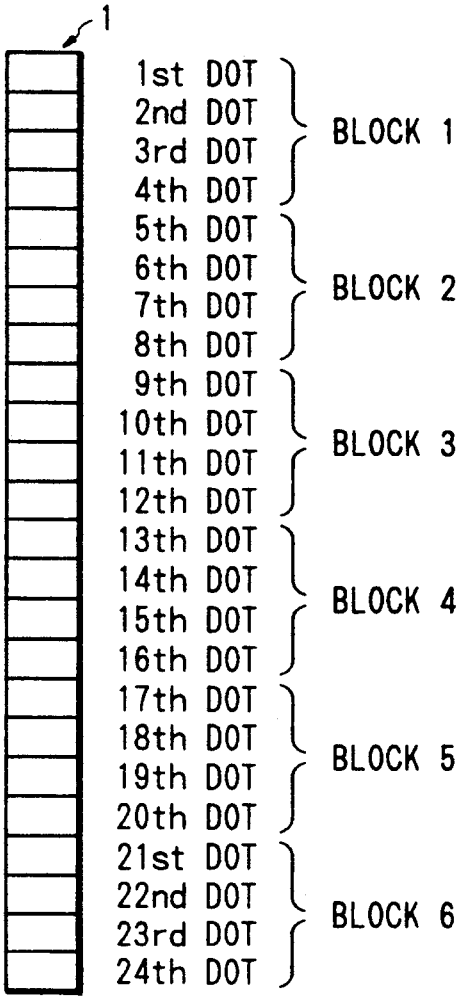
FIG. 1 is a heating elements' row of a thermal head to which the present invention is applied.

FIG. 1 shows a heating elements' row of a thermal head to which the embodiment of the present invention is embodied. In this embodiment, the thermal head is consisted of twenty-four heating elements being disposed in a single row. That is, the heating elements' row 1 includes 24 heating elements (from 1st dot to 24th dot), and every 4 heating elements constitutes one block and, therefore, the heating elements' row is divided in a manner such that there are formed totally 6 blocks (from 1st block to 6th block) each including 4 heating elements.

Figure 2:
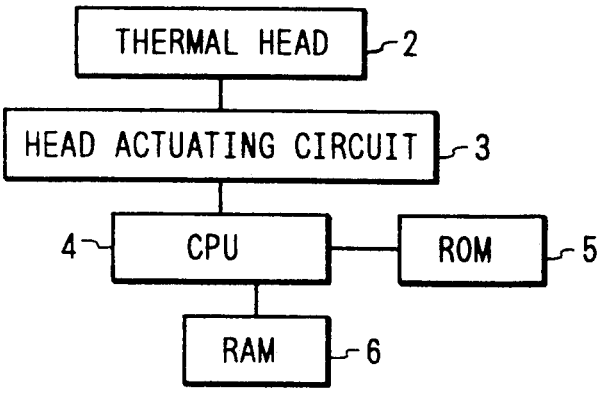
FIG. 2 is a block diagram showing one example of a control circuit which realizes the method of the present invention; and, FIG. 3 is a flow chart illustrating one embodiment of the control method for the present invention.

FIG. 2 is a block diagram showing one example of a control circuit which realizes the method of the present invention. A thermal head 2 is connected to a head actuating circuit 3. The head actuating circuit 3 is connected to a CPU (i.e. Central Processing Unit) 4. And further, the CPU 4 is connected to a ROM (i.e. Read Only Memory) 5 and a RAM (i.e. Random Access Memory) 6.

When the thermal head is actuated, the CPU 4 performs various calculations using various parameters stored in the ROM 5 as described later. And, the time period for turning on electricity to each heating element of the thermal head is calculated. The process of this calculation and the previous time period for turning on electricity are temporarily stored in the RAM 6. And, if all the calculations for obtaining time periods for turning on electricity to each heating element are accomplished, this data is fed to the head actuating circuit 3 so that the thermal head 2 is actuated based on this data.

In this embodiment, the last time period for turning on electricity to each heating element (i.e. each dot) is defined as $t_n$ (n=1, 2, - - - 24). The coefficients for transducing the time period for turning on electricity to heat accumulation are defined as $\alpha$ and $\beta$. The value $\alpha$ expresses a coefficient applied to a single heating element in the case that the time period for turning on electricity tn is transduced into the heat accumulation amount. On the other hand, the value $\beta$ expresses a coefficient applied to a single heating elements' block in the case that the sum of the time periods for turning on electricity is transduced into the overall heat accumulation amount.

Accordingly, the last heat accumulation amount of each heating element being turned on electricity during time period tn becomes $\alpha \cdot t_n$. Furthermore, taking the affection of the second-last time period for turning on electricity into consideration, an accurately corrected previous heat accumulation amount of each heating element becomes $\alpha \cdot t_n + \epsilon(\alpha \cdot t_n')$. The value $t_n'$ expresses the second-last time period for turning on electricity. The value $\epsilon$ expresses a coefficient for obtaining remainder of the heat accumulation after subtracted the heat amount corresponding to the reduction amount by radiation phenomenon in the certain dot n.

Though the last heat accumulation amount of each heating element adopted in the present invention can be calculated from the last time period for turning on electricity to each heating element, more accurate heat accumulation amount can be calculated based on a plurality of previous time periods for turning on electricity in each heating element and the last time period for turning on electricity in its neighbor heating element.

On the other hand, the sum of the heat accumulation in each block is expressed as shown in the following formula 1.

Formula 1

$$\text{block 1: } \sum_{m=1}^{4} (\beta \cdot t_m)$$

$$\text{block 2: } \sum_{m=5}^{8} (\beta \cdot t_m)$$

$$\text{block 3: } \sum_{m=9}^{12} (\beta \cdot t_m)$$

$$\text{block 4: } \sum_{m=13}^{16} (\beta \cdot t_m)$$

$$\text{block 5: } \sum_{m=17}^{20} (\beta \cdot t_m)$$

$$\text{block 6: } \sum_{m=21}^{24} (\beta \cdot t_m)$$

Here, if taking the affection of the second-last time period for turning on electricity into consideration, an accurately corrected previous sum of heat accumulation amount of each heating elements' block is expressed as shown in the following formula 2.

Formula 2

$$\text{block 1: } \sum_{m=1}^{4} (\beta \cdot t_m) + C \cdot \sum_{m=1}^{4} (\beta \cdot t'_m)$$

$$\text{block 2: } \sum_{m=5}^{8} (\beta \cdot t_m) + C \cdot \sum_{m=5}^{8} (\beta \cdot t'_m)$$

$$\text{block 3: } \sum_{m=9}^{12} (\beta \cdot t_m) + C \cdot \sum_{m=9}^{12} (\beta \cdot t'_m)$$

$$\text{block 4: } \sum_{m=13}^{16} (\beta \cdot t_m) + C \cdot \sum_{m=13}^{16} (\beta \cdot t'_m)$$

$$\text{block 5: } \sum_{m=17}^{20} (\beta \cdot t_m) + C \cdot \sum_{m=17}^{20} (\beta \cdot t'_m)$$

$$\text{block 6: } \sum_{m=21}^{24} (\beta \cdot t_m) + C \cdot \sum_{m=21}^{24} (\beta \cdot t'_m)$$

Here, the value $t_m$ in the above formulas 1 and 2 denotes the last time period for turning on electricity to certain dot in the block. And, the value $t_m'$ in the above formulas 1 and 2 denotes the second-last time period for turning on electricity to certain dot in the block. Furthermore, the value C denotes a coefficient for obtaining remainder of the heat accumulation after subtracted the heat amount corresponding to the reduction amount through radiation phenomenon in the certain heating elements' block.

Though the last sum of heat accumulation amount of each heating element' block adopted in the present invention can be calculated by obtaining the last heat accumulation in each heating element in each block and, in turn, summing these amounts, in this case as well as above-described method, the last heat accumulation amount in each heating element is calculated in the same way as the above-described method.

After calculating the heat accumulation amount of each heating element and the sum of the heat accumulation amount of each block, the time period for turning on electricity to each heating element is determined as follows.

That is, if the time period for turning on electricity to each dot to be actuated for printing operation is defined as $T_n$ (n=1, 2, - - - 24), the time period $T_n$ is expressed as shown in the following formula 3.

Formula 3

1st to 4th dots: $T_n = t_{max} - \tau \cdot \alpha \cdot t_n - \delta \cdot \sum_{m=1}^{4} (\beta \cdot t_m)$ 5th to 8th dots: $T_n = t_{max} - \tau \cdot \alpha \cdot t_n - \delta \cdot \sum_{m=5}^{8} (\beta \cdot t_m)$ 9th to 12th dots: $T_n = t_{max} - \tau \cdot \alpha \cdot t_n - \delta \cdot \sum_{m=9}^{12} (\beta \cdot t_m)$ 13th to 16th dots: $T_n = t_{max} - \tau \cdot \alpha \cdot t_n - \delta \cdot \sum_{m=13}^{16} (\beta \cdot t_m)$ 17th to 20th dots: $T_n = t_{max} - \tau \cdot \alpha \cdot t_n - \delta \cdot \sum_{m=17}^{20} (\beta \cdot t_m)$ 21th to 24th dots: $T_n = t_{max} - \tau \cdot \alpha \cdot t_n - \delta \cdot \sum_{m=21}^{24} (\beta \cdot t_m)$ Moreover, if taking the affection of second-last time period for turning on electricity into consideration, they are expressed as shown in the following formula 4.

Formula 4

1st to 4th dots: $T_n = t_{max} - \tau \cdot \{\alpha \cdot t_n + \epsilon(\alpha \cdot t'_n)\} - \delta \cdot \left\{ \sum_{m=1}^{4} (\beta \cdot t_m) + \text{Ç} \cdot \sum_{m=1}^{4} (\beta \cdot t'_m) \right\}$ 5th to 8th dots: $T_n = t_{max} - \tau \cdot \{\alpha \cdot t_n + \epsilon(\alpha \cdot t'_n)\} - \delta \cdot \left\{ \sum_{m=5}^{8} (\beta \cdot t_m) + \text{Ç} \cdot \sum_{m=5}^{8} (\beta \cdot t'_m) \right\}$ 9th to 12th dots: $T_n = t_{max} - \tau \cdot \{\alpha \cdot t_n + \epsilon(\alpha \cdot t'_n)\} - \delta \cdot \left\{ \sum_{m=9}^{12} (\beta \cdot t_m) + \text{Ç} \cdot \sum_{m=9}^{12} (\beta \cdot t'_m) \right\}$ 13th to 16th dots: $T_n = t_{max} - \tau \cdot \{\alpha \cdot t_n + \epsilon(\alpha \cdot t'_n)\} - \delta \cdot \left\{ \sum_{m=13}^{16} (\beta \cdot t_m) + \text{Ç} \cdot \sum_{m=13}^{16} (\beta \cdot t'_m) \right\}$ 17th to 20th dots: $T_n = t_{max} - \tau \cdot \{\alpha \cdot t_n + \epsilon(\alpha \cdot t'_n)\} - \delta \cdot \left\{ \sum_{m=17}^{20} (\beta \cdot t_m) + \text{Ç} \cdot \sum_{m=17}^{20} (\beta \cdot t'_m) \right\}$ 21th to 24th dots: $T_n = t_{max} - \tau \cdot \{\alpha \cdot t_n + \epsilon(\alpha \cdot t'_n)\} - \delta \cdot \left\{ \sum_{m=21}^{24} (\beta \cdot t_m) + \text{Ç} \cdot \sum_{m=21}^{24} (\beta \cdot t'_m) \right\}$ In the above formulas 3 and 4, the value $t_{max}$ expresses a time period for turning on electricity in the case that there is no heat accumulation in the thermal head. On the other hand, the value $\tau \cdot \alpha \cdot t_n$ or the value $\tau \cdot \{\alpha \cdot t_n + \epsilon(\alpha \cdot t_n')\}$ corresponds to the corrected time period for turning on electricity based on the heat accumulation in each dot. Further, the value $\delta \cdot \Sigma(\beta \cdot t_m)$ or the value $\delta \cdot \{\Sigma(\beta \cdot t_m) + \text{Ç} \cdot \Sigma(\beta \cdot t_m')\}$ corresponds to the corrected time period for turning on electricity based on the sum of heat accumulations in each block.

Moreover, the values $\tau$ and $\delta$ denote coefficients for transducing heat accumulation to time, respectively. The value of the coefficient $\delta$ is set in such a manner that the time period for turning on electricity becomes longer in the block located at the end than the block located at the center in the heating elements' row.

In the present embodiment, the coefficient $\delta$ is set to satisfy the condition $\delta 3 > \delta 2 > \beta 1$ ($>0$ ). As specific values for $\delta$, it is for example determined that $\delta 3 : \delta 2 : \delta 1 = 100:97:93$.

Figure 3:
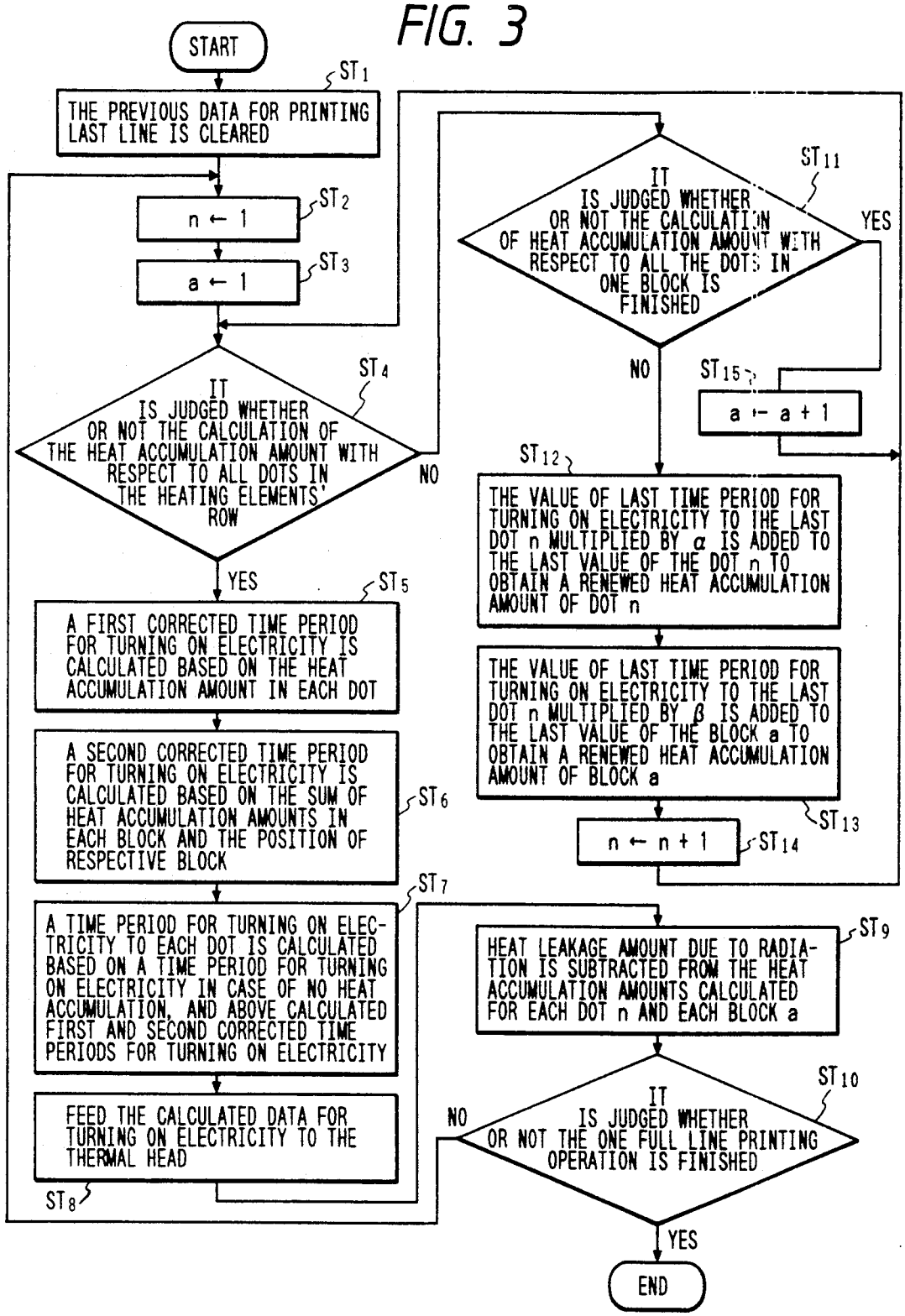

FIG. 3 is a flow chart showing one example of procedure for determining time period of turning on electricity to the heating element of the thermal head to perform a printing operation in the printing apparatus incorporates the present invention in it. At first, in the step ST1, the previous data for printing last line is cleared. Then, in the step ST2, the dot number n is set to be 1. And, further, in the step ST3, the block number a is set to be 1.

Subsequently, in the step ST4, it is judged whether or not the calculation of the heat accumulation amount with respect to all dots in the heating elements' row. If the judgement in the step ST4 is YES, the program proceeds to step ST5. In the step ST5, the corrected time based on the heat accumulation amount in each dot is calculated as a first corrected time period for turning on electricity. Then, the program proceeds to step ST6, then the sum of heat accumulation amount in each block is transduced into time through the aforementioned formulas 1 or 2 and, in turn, the obtained time is further corrected in accordance with the position of respective block in order to calculate a second corrected time period for turning on electricity.

Next, the program proceeds to the step ST7, then the time period for turning on electricity to each dot is calculated based on the above-described formulas 3 or 4 by using the time period for turning on electricity in case of no heat accumulation, and above calculated first and second corrected time periods for turning on electricity. After that, the program proceeds to step ST8 to feed this calculated time period for turning on electricity to the thermal head actuating circuit for performing the printing operation.

Subsequently, in the step ST9, the heat leakage amount due to radiation is subtracted from the heat accumulation amounts calculated for each dot n and each block a. The obtained value through above subtraction is utilized for the calculation of next heat accumulation. Then, the program proceeds to step ST10 to judge whether or not the one full line printing operation is finished. If the judgement in the step ST10 is NO, the program returns to the step ST2 to repeat the same procedure for the next digit.

On the other hand, returning to the step ST4, if the calculation of the heat accumulation amount with respect to all dots in the heating elements' row is not accomplished, the program proceeds to the step ST11. In the step ST11, it is further judged whether or not the calculation of heat accumulation amount with respect to all the dots in one block is finished. If the judgement in the step ST11 is NO, the program proceeds to the next step ST12. In the step ST12, the value of last time period for turning on electricity to the last dot n multiplied by a is added to the last value of the dot n to obtain a renewed heat accumulation amount of dot n.

Then, in the step ST13, the value of last time period for turning on electricity to the last dot n multiplied by $\beta$ is added to the last value of the block a to obtain a renewed heat accumulation amount of block a.

Subsequently, in the step ST14, the value n is incremented to n+1, and the program returns to step ST4. And, then the same procedure is repeated until the calculation of heat accumulation with respect to all the dots has been accomplished.

Furthermore, returning to the step ST11, if the calculation of heat accumulation of all dots in the same block is finished, the program proceeds to step ST15 to increment a to a+1. And, the same procedure is repeated until the calculation of heat accumulation with respect to all the blocks is finished.

Though, one embodiment of the actuation control method in accordance with the present invention is explained, the present invention is not limited to the above-described embodiment. For example, the number of the blocks into which the heating elements' row is divided is acceptable if it is any number no less than three. Moreover, if there are provided 48 heating elements, it is preferable to be divided into 8 blocks each including 6 heating elements so that the time period for turning on electricity is corrected in the similar way.

Still further, in case of 56 dots, the heating elements' row can be divided into 7 blocks each including 8 heating elements. And, in case of 64 dots, the heating elements' row can be divided into 8 blocks each including 8 heating elements. Thus, the time period for turning on electricity can be corrected in the similar way in any number of dots.

As is explained, according to the present invention, the heating elements' row of the thermal head is divided into a plurality of blocks and, in turn, the correction is carried out by taking the position of each block into consideration. Therefore, it becomes possible to perform an adequate control of time period for turning on electricity in response to actual heat accumulation condition in each heating element, thereby realizing a high quality printing operation.

Furthermore, the time period for turning on electricity is determined by taking into consideration that the edge block has a higher heat radiation efficiency compared with the central block in the heating elements' row of the thermal head. Therefore, undesirable printing density difference between edge portion and the central portion on the heat elements' row recognized in the conventional printing apparatus can be eliminated, thus, the high quality printing operation can be always guaranteed.

As this invention may be embodied in several forms without departing from the spirit of essential characteristics thereof, the present embodiment is therefore illustrative and not restrictive, since the scope of the invention is defined by the appending claims rather than by the description preceding them, and all changes that fall within meets and bounds of the claims, or equivalence of such meets and bounds are therefore intended to embraced by the claims.

The present disclosure relates to subject matters contained in Japanese Patent Application No. HEI 3-42579, filed on Feb. 14, 1991, which is expressly incorporated herein by reference in its entirety.

What is claimed is:

1. An actuating control method for a thermal head, said method comprising steps of:

dividing a row of heating elements provided in the thermal head into at least three blocks, each of said blocks including a plurality of heating elements;

calculating a last heat accumulation amount for each of said heating elements and last sum of heat accumulation amounts for each of said blocks;

correcting a calculated value of the last sum of heat accumulation amounts for each of said blocks based on the position of each of said blocks in the row of heating elements; and, controlling a time period for turning on electricity to each of said heating elements based on the calculated value of said last heat accumulation amount of each of said heating elements and the corrected value of said last sum of heat accumulation amounts in each of said blocks, when each of said heating elements is heated by turning on electricity.

2. An actuating control method for a thermal head in accordance with claim 1 in which said correction of the calculated value of the sum of heat accumulation amounts for each of said blocks is carried out in such a manner that said time period for turning on electricity to a block located at center in the row of heating elements is longer than said time period for turning on electricity to a block located at an edge thereof.

3. An actuating control method for a thermal head in accordance with claim 1 in which said calculation of said last heat accumulation amount for each of said heating elements is carried out by taking a previous time period for turning on electricity to each of said heating elements into consideration.

4. An actuating control method for a thermal head in accordance with claim 1 in which said calculation of said last sum of heat accumulation amounts for each of said blocks is carried out by taking a previous time period for turning on electricity to each of said heating elements in each of said blocks into consideration.

5. An actuating control method for a thermal head, said method comprising steps of:

dividing a row of heating elements provided in the thermal head into at least three blocks, each of said blocks including a plurality of heating elements:

calculating a last heat accumulation amount for each of said heating elements;

calculating a last sum of heat accumulation amounts for each of said blocks;

calculating a first corrected time period for turning on electricity by transducing said calculated last heat accumulation amount of each of said heating elements into time;

calculating a second corrected time period for turning on electricity by correcting said calculated last sum of heat accumulation amounts for each of said blocks based on the position of each of said blocks in the row of heating elements; and determining a time period for turning on electricity to each of said heating elements by correcting time period for turning on electricity in the case that there is no heat accumulation in each of said heating elements based on said first corrected time period for turning on electricity and said second corrected time period for turning on electricity, when each of said heating elements is heated by turning on electricity.

6. An actuating control method for a thermal head in accordance with claim 5 in which said determination of the time period for turning on electricity is carried out by subtracting said first corrected time period for turning on electricity and said second corrected time period for turning on electricity in the case that there is no heat accumulation in each of said heating elements.

* * * * *